US008672151B2

(12) United States Patent
Sprainis et al.

(10) Patent No.: US 8,672,151 B2
(45) Date of Patent: Mar. 18, 2014

(54) ELASTOMERIC DRAFT GEAR FOR A RAILCAR

(75) Inventors: Ronald J. Sprainis, Springfield, OR (US); Peter Gregar, Chesterton, IN (US); John M Sprainis, Springfield, OR (US)

(73) Assignee: WABTEC Corp, Wilmerding, PA (US)

( * ) Notice: Subject to any disclaimer, the term of this patent is extended or adjusted under 35 U.S.C. 154(b) by 228 days.

(21) Appl. No.: 13/233,231

(22) Filed: Sep. 15, 2011

(65) Prior Publication Data

US 2013/0068714 A1 Mar. 21, 2013

(51) Int. Cl.
*B61G 5/00* (2006.01)

(52) U.S. Cl.
USPC ..... 213/32 C; 213/75 R

(58) Field of Classification Search
USPC ..... 213/40 R, 32 C, 22, 220, 26, 75 R, 31, 213/67 R, 67 A, 69
See application file for complete search history.

(56) References Cited

U.S. PATENT DOCUMENTS

| | | | | |
|---|---|---|---|---|
| 761,795 | A | 6/1904 | Townsend | |
| 1,039,773 | A * | 10/1912 | McLarn | 379/320 |
| 1,772,414 | A * | 8/1930 | Brooke-Hunt et al. | 267/293 |
| 1,852,486 | A | 4/1932 | Sleeman | |
| 2,486,741 | A * | 11/1949 | Gabriel | 267/293 |
| 2,553,635 | A * | 5/1951 | Dath | 213/45 |
| 2,553,636 | A * | 5/1951 | Dath | 213/45 |
| 2,713,485 | A * | 7/1955 | Tillou | 267/141.1 |
| 2,726,080 | A * | 12/1955 | Withall | 267/153 |
| 2,776,057 | A | 1/1957 | Blattner | |
| 2,791,337 | A | 5/1957 | Blattner | |
| 2,801,010 | A | 7/1957 | Willison | |
| 2,810,485 | A * | 10/1957 | Housman | 213/221 |
| 2,817,445 | A | 12/1957 | Campbell | |
| 2,858,030 | A | 10/1958 | Mulcahy | |
| 2,916,163 | A | 12/1959 | Campbell | |
| 2,982,536 | A * | 5/1961 | Kordes | 267/153 |
| 3,178,036 | A | 4/1965 | Cardwell | |
| 3,279,048 | A * | 10/1966 | Grove et al. | 29/432 |
| 3,290,919 | A * | 12/1966 | Malinak et al. | 72/453.05 |
| 3,311,331 | A * | 3/1967 | Steimen | 248/633 |
| 3,447,693 | A | 6/1969 | Cardwell | |
| 3,602,465 | A * | 8/1971 | Velut | 248/616 |
| 3,637,088 | A * | 1/1972 | Bremond | 213/45 |
| 3,677,535 | A * | 7/1972 | Beck | 267/294 |

(Continued)

FOREIGN PATENT DOCUMENTS

| | | |
|---|---|---|
| DE | 1993283 | 9/1968 |
| FR | 1537310 | 8/1968 |

*Primary Examiner* — Jason C Smith
(74) *Attorney, Agent, or Firm* — James Ray & Assoc

(57) ABSTRACT

A draft gear assembly includes housing and an elastomeric spring stack disposed therewithin and including a plurality of compressible elastomeric springs disposed in series with each other. Each compressible elastomeric spring includes a compressible elastomeric pad, a rigid member positioned in direct contact with one end surface of the compressible elastomeric pad, a central aperture through a thickness of the rigid member, an abutment upstanding axially on the end surface of the compressible elastomeric pad, the abutment having a peripheral surface thereof sized to be received within the central aperture formed through the thickness of the rigid member, and an annular lip disposed on a distal end of the axial abutment in a plane being substantially transverse to the central axis, whereby an annular thickness portion of the rigid member is caged between the end surface of the compressible elastomeric pad and an inner surface of the annular lip.

44 Claims, 7 Drawing Sheets

(56) References Cited

U.S. PATENT DOCUMENTS

| | | | | | |
|---|---|---|---|---|---|
| 3,684,271 | A | * | 8/1972 | Arthur | 267/152 |
| 3,799,360 | A | | 3/1974 | Huml et al. | |
| 3,840,126 | A | | 10/1974 | Domer | |
| 3,929,729 | A | * | 12/1975 | Chung | 267/138 |
| 3,984,125 | A | * | 10/1976 | Paton et al. | 280/124.177 |
| 4,095,065 | A | | 6/1978 | Akers | |
| 4,198,037 | A | * | 4/1980 | Anderson | 267/153 |
| 4,556,678 | A | | 12/1985 | Hsiao | |
| 4,566,678 | A | * | 1/1986 | Anderson | 267/141.1 |
| 4,576,295 | A | | 3/1986 | Carlstedt | |
| 4,591,059 | A | * | 5/1986 | Hammarlund | 213/32 R |
| 4,645,187 | A | | 2/1987 | Kanjo et al. | |
| 4,681,040 | A | | 7/1987 | Brodeur et al. | |
| 4,706,826 | A | | 11/1987 | Elliott et al. | |
| 4,735,328 | A | | 4/1988 | Carlstedt | |
| 4,822,671 | A | * | 4/1989 | Carper et al. | 428/33 |
| 4,848,611 | A | | 7/1989 | Terlecky et al. | |
| 4,997,171 | A | * | 3/1991 | Toms, Jr. | 267/294 |
| 5,014,967 | A | * | 5/1991 | Wolf et al. | 267/153 |
| 5,096,076 | A | | 3/1992 | Elliott et al. | |
| 5,104,101 | A | * | 4/1992 | Anderson et al. | 267/219 |
| 5,152,409 | A | | 10/1992 | Sommerfeld | |
| 5,176,268 | A | | 1/1993 | Manley | |
| 5,305,899 | A | | 4/1994 | Kaufhold | |
| 5,312,007 | A | | 5/1994 | Kaufhold et al. | |
| 5,335,403 | A | * | 8/1994 | Jensen | 29/896.91 |
| 5,351,844 | A | * | 10/1994 | Carlstedt | 213/44 |
| 5,431,260 | A | * | 7/1995 | Gross et al. | 188/321.11 |
| 5,511,676 | A | * | 4/1996 | Holmes | 213/67 R |
| 5,529,194 | A | | 6/1996 | Merker, Jr. et al. | |
| 5,590,797 | A | | 1/1997 | Duffy et al. | |
| 6,446,820 | B1 | * | 9/2002 | Barker et al. | 213/75 R |
| 6,478,173 | B2 | * | 11/2002 | Carlstedt | 213/32 C |
| 6,488,162 | B1 | | 12/2002 | Carlstedt | |
| 6,520,360 | B1 | * | 2/2003 | Withall et al. | 213/220 |
| 6,681,943 | B2 | * | 1/2004 | Barker et al. | 213/75 R |
| 6,792,871 | B2 | * | 9/2004 | O'Donnell et al. | 104/16 |
| D524,338 | S | * | 7/2006 | Sims | D15/199 |
| 7,258,243 | B2 | * | 8/2007 | Ring et al. | 213/75 R |
| 7,264,130 | B2 | * | 9/2007 | Sommerfeld et al. | 213/31 |
| 7,338,034 | B2 | * | 3/2008 | Aspengren et al. | 267/3 |
| 7,360,756 | B2 | * | 4/2008 | Urquidi et al. | 267/293 |
| D578,039 | S | * | 10/2008 | Ely | D12/42 |
| 7,624,884 | B2 | * | 12/2009 | Palermo et al. | 213/22 |
| 2005/0011852 | A1 | * | 1/2005 | Fetterolf et al. | 213/75 R |
| 2005/0155947 | A1 | * | 7/2005 | Sommerfeld et al. | 213/75 R |
| 2006/0043045 | A1 | * | 3/2006 | Sommerfeld | 213/75 R |
| 2006/0043450 | A1 | * | 3/2006 | Tang et al. | 257/302 |
| 2008/0272079 | A1 | * | 11/2008 | Sprainis et al. | 213/26 |
| 2008/0272081 | A1 | * | 11/2008 | Sprainis et al. | 213/40 R |
| 2008/0284077 | A1 | * | 11/2008 | Sprainis et al. | 267/141.1 |
| 2009/0308829 | A1 | * | 12/2009 | Sprainis et al. | 213/32 C |
| 2013/0068714 | A1 | * | 3/2013 | Sprainis et al. | 213/32 C |

* cited by examiner

ELASTOMERIC DRAFT GEAR FOR A RAILCAR

CROSS-REFERENCE TO RELATED APPLICATIONS

This application closely related to co-pending U.S. Ser. No. 13/233,370 entitled "Compressible Elastomeric Spring". This application is being assigned to the assignee of the present invention and the disclosure of this co-pending application is hereby incorporated by reference thereto.

This application is closely related to U.S. Ser. No. 12/150,777 entitled "Combination Yoke and Elastomeric Draft Gear", to U.S. Ser. No. 12/150,808 entitled "Combination Yoke and Elastomeric Draft Gear Having A Friction Mechanism", and to U.S. Ser. No. 12/150,927 entitled "Elastomeric Draft Gear Having A Housing". These applications are assigned to the assignee of the present invention and the disclosures of these applications are hereby incorporated by reference thereto.

FIELD OF THE INVENTION

The present invention relates, in general, to draft gear assemblies for absorbing and dissipating energy during railcar operation of a passenger or freight railcar and applied to the draft gear assembly along a central axis thereof and, more particularly, this invention relates to draft gear assemblies employing compressible elastomeric spring stacks having a novel arrangement for attaching elastomeric pads to plate shaped members axially disposed in series with each other and, yet more particularly, the instant invention relates to a method of assembling draft gear assemblies employing the elastomeric compressible spring.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

Prior to conception and design of the instant invention, efforts have been made to provide draft gear assemblies for cushioning buff and draft dynamic impact forces encountered during make-up and operation of a railway vehicle that employ elastomeric springs. While prior art inventions, including the cross-referenced related application, describe and teach various improvements to the elastomeric draft gears utilizing such compressible elastomeric spring stacks, it has been found that additional improvements are required in the area of controlling radial expansion of the elastomeric members disposed in series with each other within the draft gear housing and assembling draft gear assemblies, particularly in the area of assembling compressible elastomeric spring stacks in combination with a hollow draft gear housing.

SUMMARY OF THE INVENTION

The invention provides a draft gear assembly for cushioning buff and draft dynamic impact forces encountered during make-up and operation of a railcar. The draft gear assembly includes a housing. An elastomeric spring stack is disposed within the housing along the central axis. The compressible elastomeric spring stack includes a plurality of compressible elastomeric springs disposed in series with each other. Each of the plurality of compressible elastomeric springs includes a compressible elastomeric pad, a rigid member having one surface thereof positioned in direct contact with one end surface of the compressible elastomeric pad, a central aperture formed through a thickness of the rigid member, an abutment upstanding axially on the one end surface of the compressible elastomeric pad, the abutment having a peripheral surface thereof so sized that the abutment is received within the central aperture formed through the thickness of the rigid member, and an annular lip disposed on a distal end of the axial abutment in a plane being substantially transverse to the central axis, whereby an annular thickness portion of the rigid member is caged between the one end surface of the compressible elastomeric pad and an inner surface of the annular lip.

The invention also provides a method of assembling a draft gear assembly, the method includes the step of providing a hollow housing having a closed end and an axially opposite open end. Next, providing a plurality of compressible elastomeric springs, each of the plurality of compressible elastomeric springs including a compressible elastomeric pad secured axially to a rigid member and having an axial bore formed through thickness of the compressible elastomeric pad and through thickness of the rigid member. Then, stacking the plurality of compressible elastomeric springs into the hollow housing in an axial manner along a longitudinal axis of the draft gear assembly. Finally, compressing the plurality of compressible elastomeric springs along the longitudinal axis of the draft gear assembly.

OBJECTS OF THE INVENTION

It is, therefore, one of the primary objects of the present invention to provide a draft gear assembly employing a compressible elastomeric spring stack including a plurality of elastomeric pads and plate shaped members disposed in series with each other along a longitudinal axis of the draft gear assembly.

Another object of the present invention is to provide an elastomeric draft gear assembly wherein an elastomeric pad in a compressible elastomeric spring stack includes an axial lip disposed on one end of the elastomeric pad so as to cage a thickness portion of a plate shaped member.

Yet another object of the present invention is to provide an elastomeric draft gear assembly that includes an elastomeric pad having an axial bore.

A further object of the present invention is to provide a method for installing elastomeric spring stack within the draft gear housing.

An additional object of the present invention is to provide an elastomeric draft gear assembly that includes control of radial expansion of compressible elastomeric spring stack during operation of the draft gear assembly.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
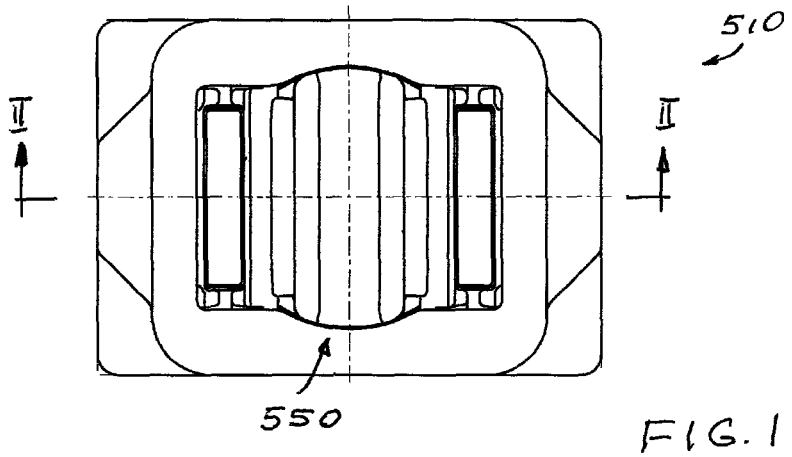
FIG. 1 is a top planar view of a draft gear assembly.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-7, therein is illustrated a draft gear assembly, generally designated as 510 that is conventionally employed for cushioning buff and draft dynamic impact forces encountered during make-up and operation of a railcar (not shown) and applied to one end of the draft gear assembly 510 along a central axis 512 thereof. The draft gear assembly 510 includes a housing which is preferably rigid and is manufactured from metal. In one form, the housing, generally designated as 520, is generally provided as a conventional draft gear housing having four generally solid side walls defining a hollow interior 522 and further defining a closed end 524 and an axially opposite open end 540.

The draft gear assembly 510 further includes a compressible elastomeric spring stack, generally designated as 500, which is disposed within the housing 520 along the central axis 512. The detail description of the compressible elastomeric spring stack 500 is disclosed in the co-pending U.S. Ser. No. 13/233,370 entitled "Compressible Elastomeric Spring" and will be omitted in this document for the sake of brevity.

Briefly, the compressible elastomeric spring stack 500 including a plurality of compressible elastomeric springs 400 disposed in series with each other. Each of the plurality of compressible elastomeric springs 400 includes a compressible elastomeric pad 408 and a rigid member 440 having one surface thereof positioned in direct contact with one end surface of the compressible elastomeric pad 408. Optional compressible elastomeric pad 409 may be provided at one terminal end of the compressible elastomeric spring stack 500 so as to position an end surface of each terminal elastomeric pad in direct contact with the rigid surface of the closed end 524 of the housing 520 and friction cushioning mechanism 550 to be described later in this document. When provided, the compressible elastomeric pad 409 has one end surface thereof positioned in direct contact with another surface of a rigid member 440 disposed at one terminal end of the compressible elastomeric spring stack 500.

Figure 11:
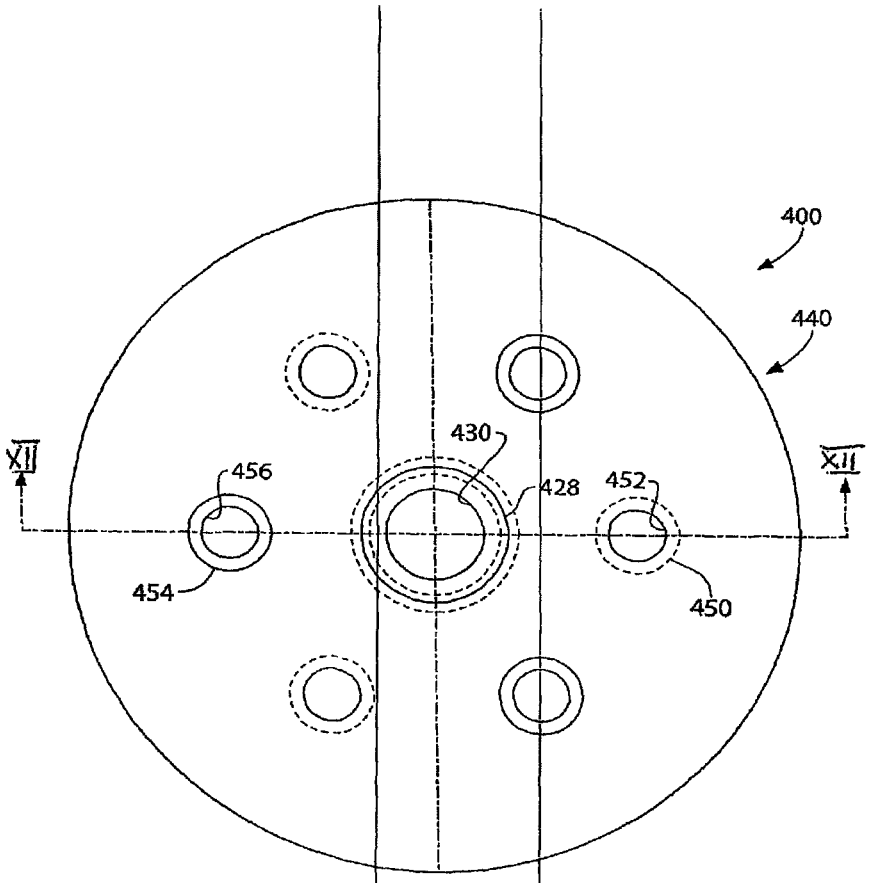
FIG. 11 is a planar view of an elastomeric spring employed within the elastomeric spring stack of FIGS. 1-2.
Figure 12:
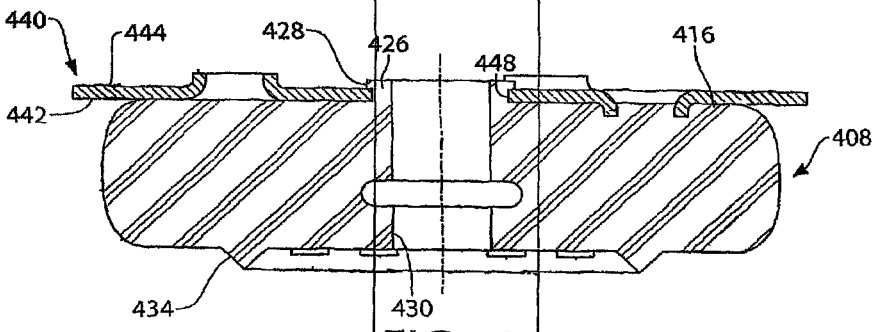
FIG. 12 is a cross-sectional elevation view of the elastomeric spring along lines XII-XII of FIG. 11.

In a particular reference to FIGS. 11-12, each compressible elastomeric pad 408, 409 includes a substantially solid abutment 426 upstanding axially on one end surface 416. In the presently preferred embodiment of the invention, the substantially solid abutment 426 has a generally round cross-section in a plane being substantially transverse to the central axis 512 and further has each of a substantially uniform thickness and substantially uniform diameter throughout.

Each compressible elastomeric pad 408, 409 further includes a peripheral lip 428 which is disposed on a distal end of the substantially solid abutment 426 in a plane being substantially transverse to the central axis 412.

An axial bore 430 is formed through the thickness of the compressible elastomeric pads 408, 409 and essentially through the thickness of the rigid members 440, so as to provide a continuous bore through the entire compressible elastomeric spring stack 500.

In further reference to FIGS. 11-12, the rigid member 440 is essentially a plate shaped member having a pair of substantially planar surfaces 442 and 444, spaced apart from each other along the central axis 412 to define a thickness of the at least one rigid member 440. One of the pair of substantially planar surfaces, referenced with numeral 442, is positioned in direct contact with essentially the entire end surface 416 of the compressible elastomeric pad 408, 409. A central aperture 448 is formed through the thickness of the at least one rigid member 440 and is so sized that the axial abutment 426 is received operatively therewithin. Term "operatively" means herein that the axial abutment 426 is allowed to pass through the central aperture 448 so that the distal end of the axial abutment 426 extends a predetermined distance beyond an opposite one of the pair of substantially planar surfaces, referenced with numeral 444, of the at least one rigid member 440. More importantly, a thickness portion of the at least one rigid member 440 around the peripheral edge of the central aperture 448 is being caged between one of the end surface 416 and an inner surface of the peripheral lip 428, as best shown in FIG. 12.

The at least one rigid member 440 includes rings 450, each adapted with a through bore 452 and oppositely facing rings 454, each adapted with a through bore 456.

For the reasons to be explained later, at least fifteen percent (15%) of a length of the axial bore 430 in each compressible elastomeric pad 408, 409 has a substantially uniform diameter throughout.

Figure 4:
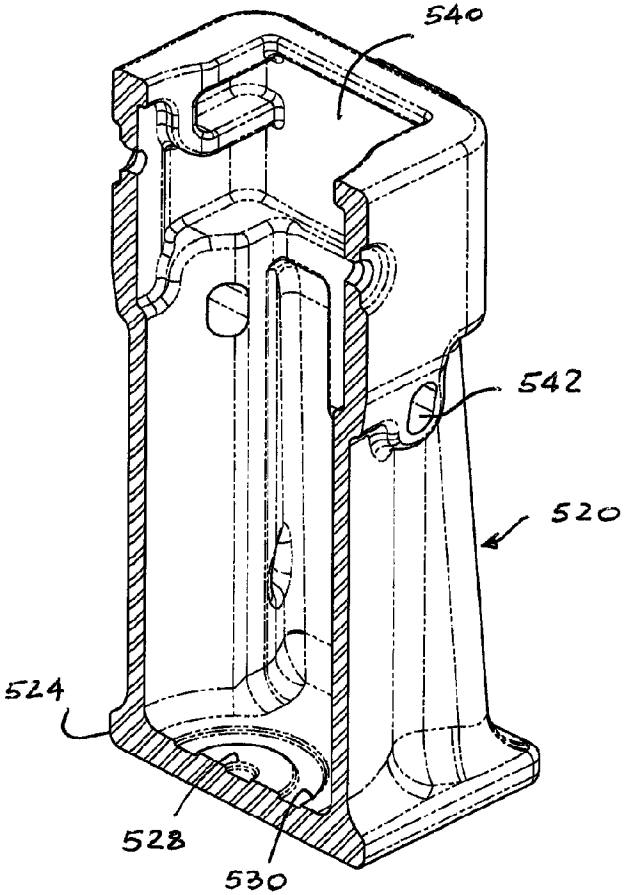
FIG. 4 illustrates a cross-sectional elevation view of the draft gear housing along lines IV-IV of FIG. 3.
Figure 3:
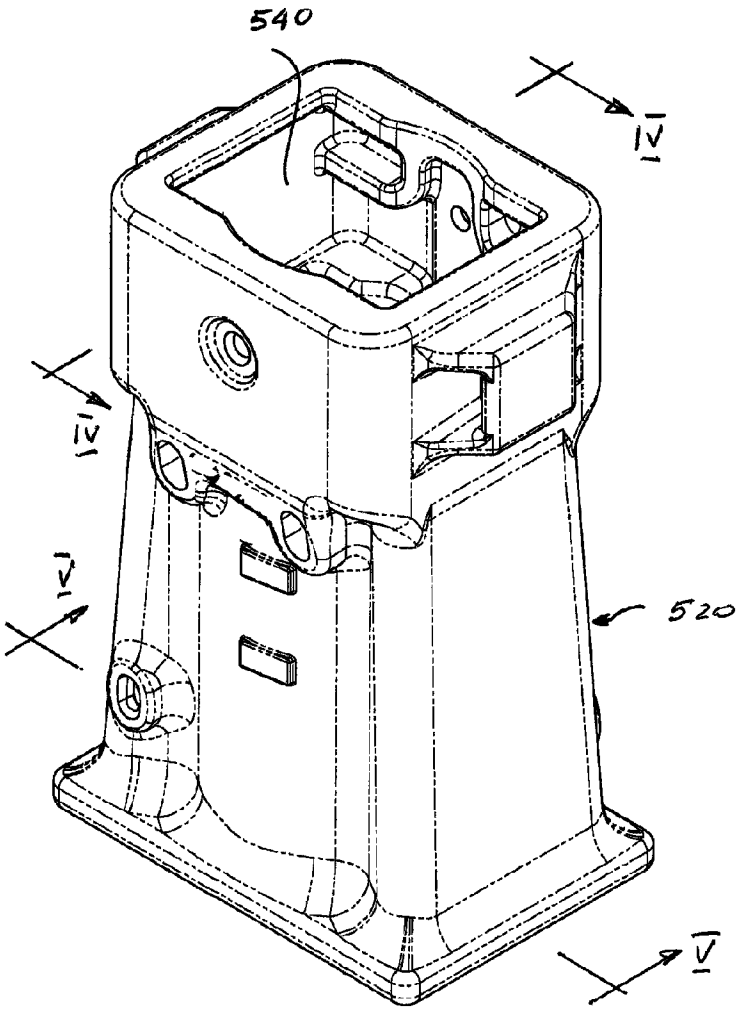
FIG. 3 is a perspective view of a draft gear housing employed within draft gear assembly of FIGS. 1-2.
Figure 5:
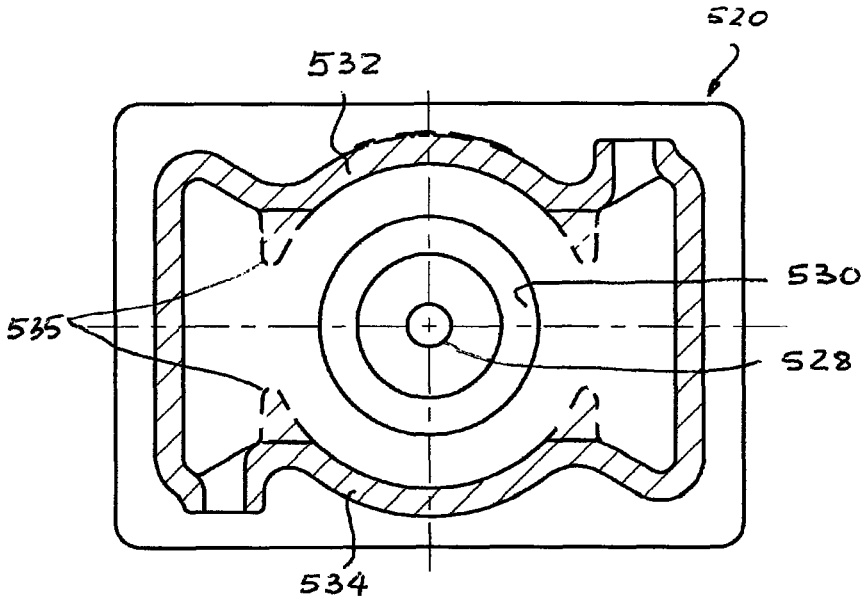
FIG. 5 illustrates a cross-sectional planar view of the draft gear housing along lines V-V of FIG. 3.

The housing 520 includes means for controlling radial expansion of the compressible elastomeric spring stack 500. In one form, presently preferred, such means for controlling the radial expansion of the compressible elastomeric spring stack 500 includes means for locating at least one end of the compressible elastomeric spring stack 500. More specifically, as best shown in FIGS. 4-5, the presently preferred locating means includes a groove 530 that preferably has an annular shape and is disposed axially on a generally planar inner surface 526 of the closed end 524 of the housing 520. The annular groove 530 is provided to receive the annular ridge 434 of the compressible elastomeric pad 408 and has a presently preferred generally rectangular cross-sectional shape, so as to accommodate compression of the annular ridge 434 during operation of the draft gear assembly 510 wherein, under such compression, the annular ridge 434 essentially fills the volume of the annular groove 530. The length of such generally rectangular cross-sectional shape is aligned generally parallel with the inner surface 526 so as to increase a size of the elastomeric material in the radial direction relative to central axis 512 when the annular ridge 434 flattens during compression and essentially fills the volume of the annular groove 530.

In another form, the means for controlling the radial expansion of the compressible elastomeric spring stack 500 may include at least a pair of side walls, referenced with numerals 532 and 534 and best shown in FIG. 5, of the draft gear housing 520, each having an inner curved surface thereof disposed at a predetermined nominal distance from peripheral edges of the rigid members 440. Each side wall 532, 534 may include a pair of optional extensions 535 so as to increase the usable surface area of the side walls 532, 534.

Figure 6:
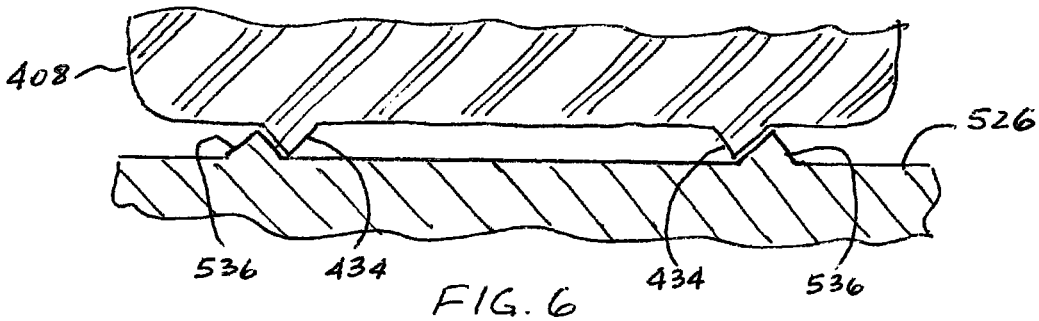
FIG. 6 is a partial cross-sectional view of the draft gear assembly of FIGS. 1-2, particularly illustrating one alternative embodiment of locating elastomeric spring stack on a bottom wall of the housing of FIGS. 3-4.

In yet another form, as shown in FIG. 6, the means for controlling the radial expansion of the compressible elastomeric spring stack 500 may include another ridge 536 that upstands on the inner surface 526 of the closed end 524 and is generally provided in place of the groove 530. The ridge 536 is so sized that after assembly it encircles the annular groove 434 of the compressible elastomeric pad 408.

Figure 7:
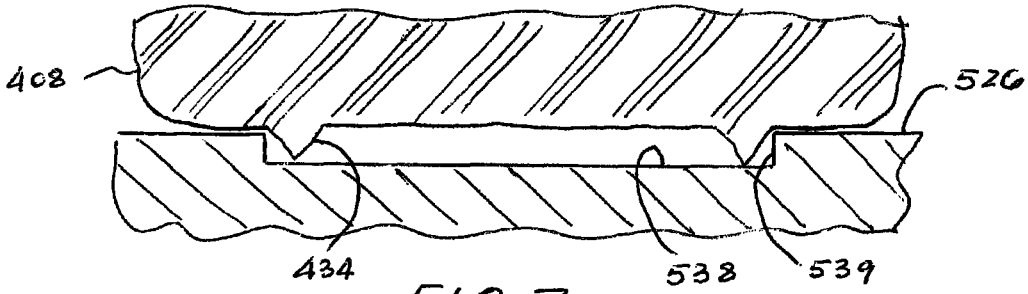
FIG. 7 is a partial cross-sectional view of the draft gear assembly of FIGS. 1-2, particularly illustrating another alternative embodiment of locating elastomeric spring stack on a bottom wall of the housing of FIGS. 3-4.

In yet another form, as shown in FIG. 7, the means for controlling the radial expansion of the compressible elastomeric spring stack 500 may include a recess 538 disposed within the inner surface 526 of the closed end 524 and being so sized that the annular ridge 434 fits therewithin and wherein the peripheral wall 539 of the recess 538 restrains radial movement of the compressible elastomeric spring stack 500.

Figure 2:
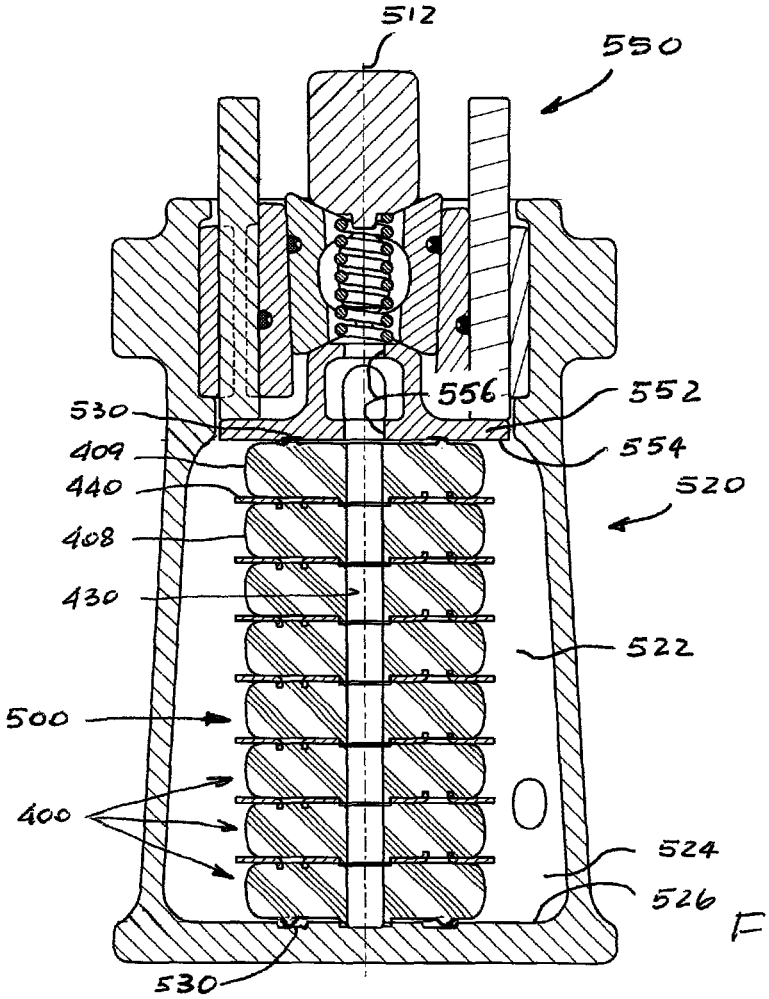
FIG. 2 is a cross-sectional elevation view of the draft gear assembly along lines II-II of FIG. 1.

In further reference to FIGS. 1-2, the open end 540 of the housing 520 is adapted to receive the friction cushioning mechanism, generally designated as 550. Such friction cushioning mechanism 550 may be of any conventional type, for example, as disclosed in the U.S. Ser. No. 12/150,927 entitled "Elastomeric Draft Gear Having A Housing" and incorporated by reference herein. Thus, the detail description of the friction cushioning mechanism 550 will be omitted in this document for the sake of brevity.

The friction cushioning mechanism 550 is further provided with means for locating an opposite end of the elastomeric compressible spring stack 500 on a generally planar inner end surface 554 of the friction cushioning mechanism 550. Such inner end surface 554 is further provided in a spring seat 552. The means for locating one end of the elastomeric compressible spring stack 500 on an inner end surface 554 preferably includes another annular grove 530 but may also include the above described ridge 536 or recess 538.

Figure 8:
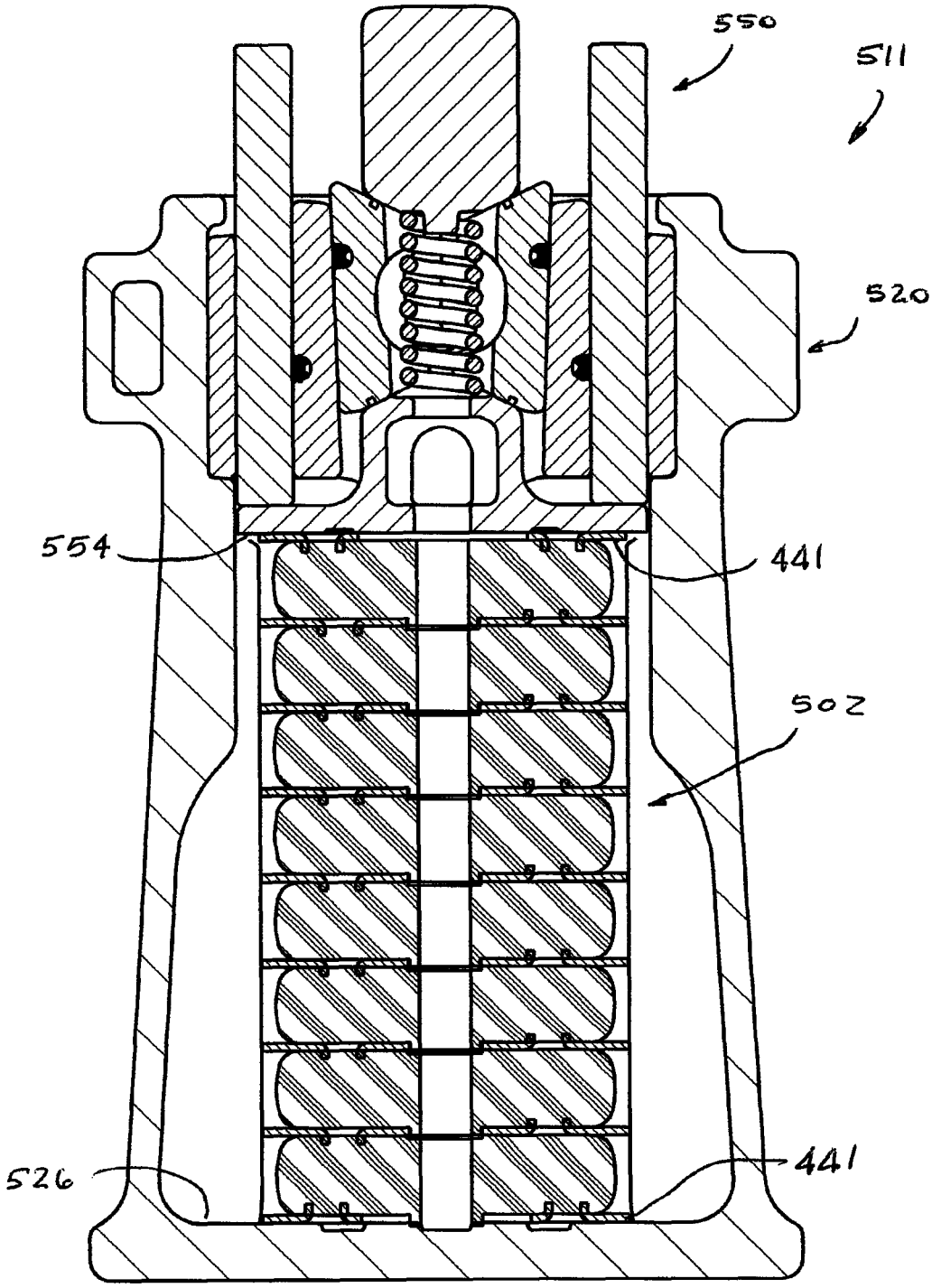
FIG. 8 is a cross-sectional elevation view of the draft gear assembly of FIG. 2, particularly illustrating a pair of terminal plate shaped members of the elastomeric spring stack.

Now in reference to FIG. 8, therein is illustrated a draft gear assembly, generally designated as 511, which is constructed essentially identical to the draft gear assembly 510, except for employment of the spring stack 502, having a pair of terminal rigid plate shaped members 441. The terminal rigid plate shaped members 441 may be positioned on respective surfaces 526 and 554 so as to at least restrain if not eliminate radial movement the spring stack 502. For example, each plate 441 may be disposed within above described recess 538. Or the terminal rigid plate shaped members 441 may be positioned in accordance with teachings of the above-referenced applications incorporated by reference herein.

Instant invention also contemplates that the compressible elastomeric spring stack 500 may be provided with only one terminal rigid plate shaped member, wherein the spring stack 500 will be exclusively composed of the compressible elastomeric springs 400 disposed in series with each other.

Figure 9:
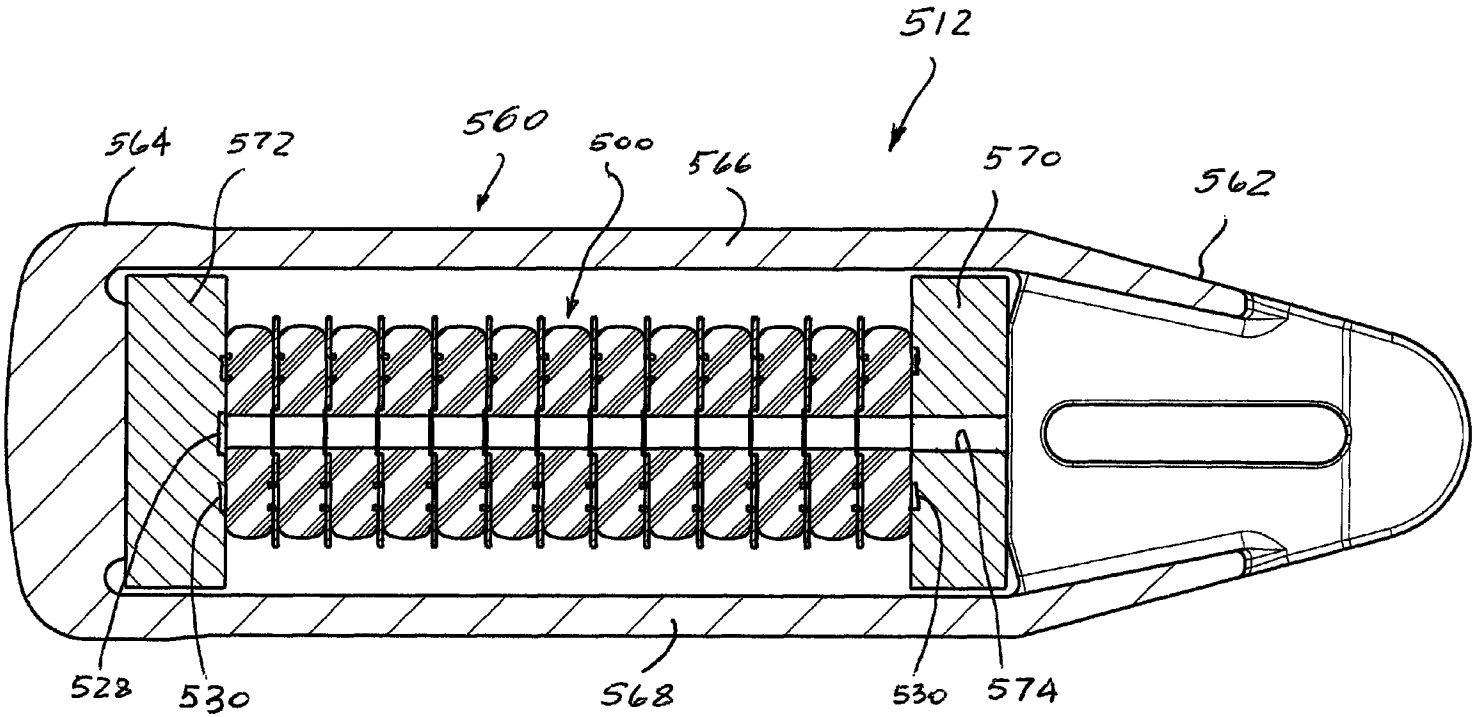
FIG. 9 is a cross-sectional elevation view of the draft gear assembly employing elastomeric spring stack of FIGS. 1-2 in combination with a conventional yoke.

In another form, shown in FIG. 9, a draft gear assembly, generally designated as 512, includes a housing, generally designated as 560, and defining a yoke end 562 adapted to connect to an end of a coupler shank (not shown), a butt end 564 axially opposing the yoke end 562, a pair of elongated spaced-apart top and bottom strap members, 566 and 568 respectively, each having an inner surface, an outer surface, a front end and a rear end, the rear end of each strap member 566, 568 being joined to the butt end 546 of the housing 560 and the front end of the each strap member 566, 568 being joined to the yoke end 562 of the housing 560. Also in a conventional manner, the draft gear assembly 512 of FIG. 9, further includes a coupler follower 570 positioned forward of the compressible elastomeric spring stack 500 and a rear follower 572 positioned rearward of the compressible elastomeric spring stack 500 when the draft gear assembly 510 is installed on the railcar (not shown). Each follower 570, 572 is shown as including an annular groove 530. Furthermore, the rear follower 572 includes the axial bore 528, while the front follower 570 is provided with an axial through aperture 574.

Figure 10:
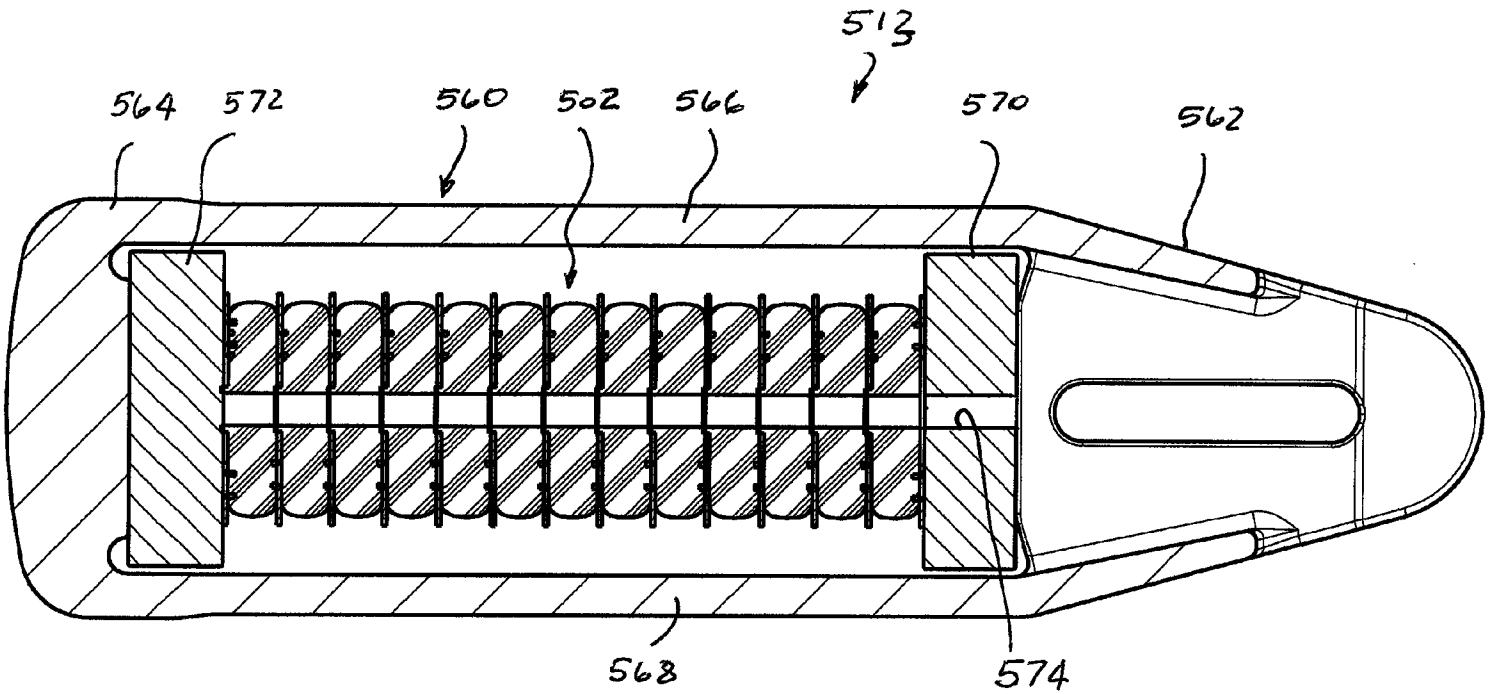
FIG. 10 is another cross-sectional elevation view of the draft gear assembly employing elastomeric spring stack of FIGS. 1-2 in combination with a conventional yoke, particularly illustrating a pair of terminal plate shaped members of the elastomeric spring stack.

Finally, FIG. 10 illustrates a draft gear assembly, generally designated as 513, that is essentially constructed as the draft gear assembly 512, except that the spring stack 502 replaces the spring stack 500 and additional restraining elements are incorporated into the inwardly disposed surfaces of the followers 470 and 472.

The construction of the pads 408 and 409 and the manner in which these pads are mechanically interlocked with the rigid members 440, 441 affords for a presently preferred method of manufacturing the draft gear assembly 510, wherein the method includes the step of providing a hollow housing 520 having a closed end 524 and an axially opposite open end 540. Then, the method includes the step of providing a plurality of compressible elastomeric springs 400, each of the plurality of compressible elastomeric springs 400 including a compressible elastomeric pad 408 secured axially to a rigid member 440 and having an axial bore 430 formed through thickness of the compressible elastomeric pad 408 and essentially through the thickness of the rigid member 440. Next, the plurality of compressible elastomeric springs 400 are stacked into the hollow housing 520 through the open end 540 in an axial and serial manner along the longitudinal axis 512 of the draft gear assembly 510. During stacking, end surface of the compressible elastomeric pad 408 of each compressible elastomeric spring 400 is placed in direct contact with the surface of an adjacent rigid member 440. After this, the method may include an optional step of positioning another compressible elastomeric pad 409 on a surface of a terminal rigid member 440, wherein such another compressible elastomeric pad 409 has the axial bore 430 formed through a thickness thereof. Subsequently, elongated rigid member (not shown) is inserted through the axial bore 430 of each of the plurality of compressible elastomeric springs 400 and optional compressible elastomeric pad 409 when provided, although the instant invention contemplates that the inner surfaces of the side walls 532, 534 may be employed as positioning guides during assembly of the compressible elastomeric stack 500. To accommodate the end of such elongated rigid member (not shown), the central bore 528 is provided in the inner surface 526 of the closed end 524 of the housing 520. Finally, the plurality of compressible elastomeric springs 400 and the optional compressible elastomeric pad 409 are compressed along the longitudinal axis 512 of the draft gear assembly 510 so as to mechanically interlock with the rigid members 440.

Compression of the compressible elastomeric spring stack may be achieved by application of a temporary axial force to an outer end of a resulting compressible elastomeric stack.

Preferably, the method provides for positioning the seat 552 of the friction cushioning mechanism 550 in direct contact with an outer end surface of one end compressible elastomeric pad, shown as compressible elastomeric pad 409 in FIG. 2, prior to compressing the plurality of compressible elastomeric springs 400 and the compressible elastomeric pad 409. In such embodiment, the axial force is applied to the opposite end of the spring seat 512.

The method may further include the additional steps of providing an axial through bore 556 in the seat 552 of the friction cushioning mechanism 550, the step of inserting the elongated rigid member (not shown) through the axial bore 556 and the step of positioning one end of the elongated rigid member within the axial bore 556 between ends thereof. The method contemplates removal of the elongated rigid member (not shown) after compressing the plurality of springs 400 and the optional terminal elastomeric pad 409 when provided.

The step of stacking the plurality of springs 400 preferably includes a step of providing means for locating one end of the terminal compressible elastomeric pad 408 on the inner surface 526 of the closed end 524 of the housing 520 by way of positioning at least one end of the terminally located compressible elastomeric pad 408 in direct contact with an interior surface, for example such as inner surface 526 of the closed end 524 of the housing 520.

The method also contemplates the additional step of maintaining the plurality of compressible elastomeric spring stack 500 at a predetermined compressed height by way of conventional pins (not shown) inserted through the aperture 542 formed through the side wall of the hollow housing 520 and being disposed at a distance from the interior surface 526 that exceeds the length of the compressed spring stack 500. After the spring stack 500 has been compressed and the elongated rigid member (not shown) has been removed, the friction cushioning mechanism 550 is installed into the open end 540 of the hollow housing 520 in a conventional manner.

The significance of providing the center bore 430 with a substantially uniform diameter throughout of at least fifteen percent (15%) is that such center bore 430 provides a guidance for the elongated rigid member (not shown) sufficient to center all compressible elastomeric pads 408, 409 with adjacent rigid members 440 within the draft gear housing 520 prior to application of the axial force.

The above described method is substantially applicable for installing the spring stack 502 of FIG. 8 and is also applicable for installing spring stacks 500, 502 within the respective draft gear assemblies 512, 513.

It will be also understood by those skilled in the art that the at least one spring stack 500 may be employed in the draft gear types taught in U.S. Ser. No. 12/150,777 entitled "Combination Yoke and Elastomeric Draft Gear" and U.S. Ser. No. 12/150,808 entitled "Combination Yoke and Elastomeric Draft Gear Having A Friction Mechanism" incorporated by reference herein and that various teachings of such cross-referenced applications can be employed in the instant invention.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A draft gear assembly for cushioning buff and draft dynamic impact forces encountered during make-up and operation of a railcar and applied to said draft gear assembly along a central axis thereof, said draft gear assembly comprising:

(a) a housing; and (b) a compressible elastomeric spring stack disposed within said housing along said central axis, said compressible elastomeric spring stack including a plurality of compressible elastomeric springs disposed in series with each other, each of said plurality of compressible elastomeric springs including:

i. a compressible elastomeric pad, ii. a rigid member having one surface thereof positioned in direct contact with one end surface of said compressible elastomeric pad, said rigid member further having a central aperture formed through a thickness thereof, said thickness defined by another surface spaced from said one surface of said rigid member along said central axis, said one and another surfaces are planar surfaces disposed normal to said central axis, iii. an abutment upstanding axially on said one end surface of said compressible elastomeric pad, said abutment having a peripheral surface thereof so sized that said abutment is received within said central aperture formed through said thickness of said rigid member, and iv. an annular lip disposed on a distal end of said axial abutment in a plane being substantially transverse to said central axis, whereby an annular thickness portion of said rigid member is caged between said one end surface of said compressible elastomeric pad and an inner surface of said annular lip, whereby an outer surface of said lip extends above said another surface of said rigid member.

2. The draft gear assembly of claim 1, further including another compressible elastomeric pad having one end surface thereof positioned in direct contact with another surface of a terminal rigid member disposed at one end of said compressible elastomeric spring stack.

3. The draft gear assembly of claim 1, further including an axial bore formed through said thickness of said compressible elastomeric pad and through said thickness of said abutment.

4. The compressible spring, according to claim 3, wherein at least fifteen percent of a length of said axial bore has a substantially uniform diameter throughout.

5. The draft gear assembly of claim 1, wherein said housing is rigid and includes a closed end, an axially opposite open end and four generally solid side walls defining a hollow interior of said rigid housing.

6. The draft gear assembly of claim 5, wherein said housing includes means for controlling radial expansion of said compressible elastomeric spring stack.

7. The draft gear assembly of claim 6, wherein said means for controlling said radial expansion of said compressible elastomeric spring stack includes an annular ridge disposed on an end surface of a terminal compressible elastomeric pad and a recess within an inner surface of a closed end of said housing, said recess being sized to receive said annular ridge therewithin and wherein a peripheral wall of said recess restrains a radial movement of said compressible elastomeric spring stack.

8. The draft gear assembly of claim 6, wherein said means for controlling said radial expansion of said compressible elastomeric spring stack includes a pair of side walls of said housing having inner curved surfaces thereof disposed at a predetermined nominal distance from peripheral edges of said rigid members.

9. The draft gear assembly of claim 6, wherein said means for controlling said radial expansion of said compressible elastomeric spring stack includes means for locating at least one end of said compressible elastomeric spring stack.

10. The draft gear assembly of claim 9, wherein said locating means includes an annular grove disposed axially on an inner wall surface of said closed end of said housing.

11. The draft gear assembly of claim 10, wherein said annular groove has a generally rectangular cross-sectional shape.

12. The draft gear assembly of claim 6, wherein said means for controlling said radial expansion of said compressible elastomeric spring stack includes at least a pair of side walls of said housing having inner surfaces thereof disposed at a predetermined nominal distance from peripheral edges of said rigid members.

13. The draft gear assembly of claim 6, wherein said means for controlling said radial expansion of said compressible elastomeric spring stack includes an annular ridge disposed on an inner wall surface of said closed end of said housing, said inner wall surface of said closed end being positioned substantially normal to said central axis of said housing.

14. The draft gear assembly of claim 13, wherein an end of one terminal compressible elastomeric pad is positioned in direct abutment with an inner wall surface of said closed end of said housing.

15. The draft gear assembly of claim 14, further including an annular ridge disposed on an end surface of at least one terminal compressible elastomeric pad.

16. The draft gear assembly of claim 5, further comprising a friction cushioning mechanism disposed at least within said open end and means for locating one end of said elastomeric compressible spring stack on an inner end surface of said friction cushioning mechanism.

17. The draft gear assembly of claim 1, wherein said housing includes a yoke end adapted to connect to an end of a coupler shank, a butt end axially opposing said yoke end, a pair of elongated substantially parallel spaced-apart top and bottom strap members each having an inner surface, an outer surface, a front end and a rear end, said rear end of each strap member being joined to said butt end of said housing and said front end of said each strap member being joined to said yoke end of said housing.

18. The draft gear assembly of claim 17, further including a coupler follower positioned forward of said compressible elastomeric spring stack and a rear follower positioned rearward of said compressible elastomeric spring stack when said draft gear assembly is installed on the railcar.

19. The draft gear assembly of claim 18, further including a central through bore formed through a thickness of said coupler follower.

20. The draft gear assembly of claim 17, further including an annular groove formed in an inward surface of each of said coupler follower and said rear follower.

21. The draft gear assembly of claim 1, further including a plurality of rings upstanding in a predetermined pattern on each surface of said rigid member and at least partially disposed within a thickness of an adjacent compressible elastomeric pad.

22. The draft gear assembly of claim 1, further including an additional rigid member being mechanically secured to an exposed end surface of a terminal compressible elastomeric pad.

23. A method of assembling a draft gear assembly, said method comprising the steps of:

(a) providing a housing having a closed end and an axially opposite open end;

(b) providing a plurality of compressible elastomeric springs, each of said plurality of compressible elastomeric springs including a compressible elastomeric pad secured axially to a rigid member and having an axial through bore formed through a thickness of said compressible elastomeric pad and through a thickness of said rigid member;

(c) stacking said plurality of compressible elastomeric springs into said hollow housing in an axial manner along a longitudinal axis of said draft gear assembly; and (d) compressing said plurality of compressible elastomeric springs along said longitudinal axis of said draft gear assembly.

24. The method of claim 23, further including a step of inserting an elongated rigid member through said axial through bore of said each of said plurality of compressible elastomeric springs after stacking in step (c).

25. The method of claim 24, further including a step of providing an axial bore in an inner surface of said closed end of said housing and the step of positioning one end of said elongated rigid member within said axial bore.

26. The method of claim 24, further including the additional step of removing said elongated rigid member after compressing said plurality of springs in step (d).

27. The method of claim 23, wherein said method includes a step of positioning another compressible elastomeric pad on a surface of a terminal rigid member, said another compressible elastomeric pad having said axial bore formed through a thickness thereof.

28. The method of claim 23, wherein said step of compressing includes the step of applying a temporary axial force to an outer end of a terminal compressible elastomeric pad of a resulting compressible elastomeric stack.

29. The method of claim 23, wherein said method includes a step of positioning a seat of a friction cushioning mechanism at a terminal elastomeric spring after stacking said plurality of compressible elastomeric springs in step (c).

30. The method of claim 29, further including the additional steps of providing an axial bore in said seat of said friction cushioning mechanism, the step of inserting an elongated rigid member through said axial bore and the step of disposing one end of said elongated rigid member within said axial bore.

31. The method of claim 23, wherein said step of stacking said plurality of springs includes a step of positioning one end of a terminal compressible elastomeric pad in a direct contact with an inner wall surface of said closed end of said housing.

32. The method of claim 31, further including an additional step of providing means for locating said one end of said terminal compressible elastomeric pad on said inner wall surface of said closed end of said housing.

33. The method of claim 23, further including the additional step of maintaining said plurality of springs at a predetermined compressed height.

34. The method of claim 33, further including the additional step of positioning a friction cushioning mechanism in said open end of said housing.

35. The method of claim 23, further including the step of providing a plurality of rings on each surface of each rigid member.

36. A draft gear assembly for cushioning buff and draft dynamic impact forces encountered during make-up and operation of a railcar and applied to said draft gear assembly along a central axis thereof, said draft gear assembly comprising:

(a) a housing having an open end and an axially opposite closed end;

(b) a compressible elastomeric spring stack disposed within said housing along said central axis, said compressible elastomeric spring stack including a plurality of compressible elastomeric springs disposed in series with each other, each of said plurality of compressible elastomeric springs including a compressible elastomeric pad affixed to a rigid member in a surface to surface contact therewith;

(c) an annular grove provided, concentric with said central axis of said housing, in an inner wall surface of said closed end of said housing; and (d) an annular ridge upstanding, concentric with said central axis of said housing, on an end surface of a terminal compressible elastomeric pad, wherein said annular ridge is sized to be received within said annular groove and wherein an end surface of said terminal compressible elastomeric pad is positioned in a direct abutment with said inner wall surface of said closed end of said housing.

37. The draft gear housing of claim 36, further comprising:

(a) a friction cushioning mechanism disposed at least within said open end of said housing;

(b) another annular grove provided, concentric with said central axis of said housing, in a surface of said friction cushioning mechanism; and (c) another annular ridge upstanding, concentric with said central axis of said housing, on an end surface of an axially opposite terminal compressible elastomeric pad, wherein said another annular ridge is sized to be received within said another annular groove and wherein an end surface of said another terminal compressible elastomeric pad is positioned in a direct abutment with said surface of said friction cushioning mechanism.

38. A draft gear assembly for cushioning buff and draft dynamic impact forces encountered during make-up and operation of a railcar and applied to said draft gear assembly along a central axis thereof, said draft gear assembly comprising:

(a) a housing having an open end and an axially opposite closed end;

(b) a compressible elastomeric spring stack disposed within said housing along said central axis, said compressible elastomeric spring stack including a plurality of compressible elastomeric springs disposed in series with each other, each of said plurality of compressible elastomeric springs including a compressible elastomeric pad affixed to a rigid member in a surface to surface contact therewith;

(c) a first annular ridge upstanding, concentric with said central axis of said housing, on an inner wall surface of said closed end of said housing; and (d) a second annular ridge upstanding, concentric with said central axis of said housing, on an end surface of a terminal compressible elastomeric pad, wherein said second annular ridge is sized to be received within said first annular ridge and wherein an end surface of said terminal compressible elastomeric pad is positioned in a direct abutment with said inner wall surface of said closed end of said housing.

39. A draft gear assembly for cushioning buff and draft dynamic impact forces encountered during make-up and operation of a railcar and applied to said draft gear assembly along a central axis thereof, said draft gear assembly comprising:

(a) a housing having an open end and an axially opposite closed end;

(b) a compressible elastomeric spring stack disposed within said housing along said central axis, said compressible elastomeric spring stack including a plurality of compressible elastomeric springs disposed in series with each other, each of said plurality of compressible elastomeric springs including a compressible elastomeric pad affixed to a rigid member in a surface to surface contact therewith;

(c) a recess provided, concentric with said central axis of said housing, in an inner wall surface of said closed end of said housing; and (d) an annular ridge upstanding, concentric with said central axis of said housing, on an end surface of a terminal compressible elastomeric pad, wherein said annular ridge is sized to be received within said recess, wherein an end surface of said terminal compressible elastomeric pad is positioned in a direct abutment with said inner wall surface of said closed end of said housing, and wherein a peripheral wall of said recess restrains a radial movement of said compressible elastomeric spring stack.

40. A draft gear assembly for cushioning buff and draft dynamic impact forces encountered during make-up and operation of a railcar and applied to said draft gear assembly along a central axis thereof, said draft gear assembly comprising:

(a) a housing having an open end adapted to connect to an end of a coupler shank and an axially opposite closed end;

(b) a coupler follower positioned within said housing adjacent said open end;

(c) a rear follower positioned within said housing adjacent said closed end;

(d) a compressible elastomeric spring stack disposed within said housing along said central axis between said coupler and rear followers, said compressible elastomeric spring stack including a plurality of compressible elastomeric springs disposed in series with each other, each of said plurality of compressible elastomeric springs including a compressible elastomeric pad affixed to a rigid member in a surface to surface contact therewith;

(e) an annular grove provided, concentric with said central axis of said housing, in an inner surface of each of said coupler and rear followers; and (f) an annular ridge upstanding, concentric with said central axis of said housing, on an end surface of each terminal compressible elastomeric pad, wherein said annular ridge is sized to be received within a respective annular groove and wherein an end surface of said terminal compressible elastomeric pad is positioned in a direct abutment with said inner surface of said each of said coupler and rear followers.

41. A draft gear assembly for cushioning buff and draft dynamic impact forces encountered during make-up and operation of a railcar and applied to said draft gear assembly along a central axis thereof, said draft gear assembly comprising:

(a) a housing having an open end and an axially opposite closed end, said housing further having a pair of side walls, each defining an inner curved surface;

(b) a compressible elastomeric spring stack disposed within said housing along said central axis, said compressible elastomeric spring stack including a plurality of compressible elastomeric springs disposed in series with each other, each of said plurality of compressible elastomeric springs including a compressible elastomeric pad affixed to a rigid member in a surface to surface contact therewith; and (c) wherein said inner curved surfaces are so disposed at a distance from peripheral surface of said compressible elastomeric spring stack that said inner curved surfaces are adapted to control a radial expansion thereof.

42. A housing for a draft gear assembly employed for cushioning buff and draft dynamic impact forces encountered during make-up and operation of a railcar and applied to said draft gear assembly along a central axis thereof, said housing comprising:

(a) an open end;

(b) a closed end spaced apart from said open end along said central axis;

(c) a continuous peripheral wall extending between said open and closed ends; and (d) an irregularity in said closed end, said irregularity being one of an annular groove provided, concentric with said central axis of said housing, in an inner wall surface of said closed end, an annular ridge upstanding, concentric with said central axis of said housing, on an inner wall surface of said closed end, and recess formed in a thickness of said wall of said closed end.

43. The housing of claim 42, further comprising an axial bore formed in said inner wall surface of said closed end.

44. A method of assembling a draft gear assembly, said method comprising the steps of:

(a) providing a housing having a closed end and an axially opposite open end;

(b) providing a plurality of compressible elastomeric springs, each of said plurality of compressible elastomeric springs including a compressible elastomeric pad secured axially to a rigid member by way of a lip caging a thickness portion of said rigid member;

(c) stacking said plurality of compressible elastomeric springs into said hollow housing in an axial manner along a longitudinal axis of said draft gear assembly; and (d) compressing said plurality of compressible elastomeric springs along said longitudinal axis of said draft gear assembly.

* * * * *